US010081214B1

(12) United States Patent
Cuadrado

(10) Patent No.: US 10,081,214 B1
(45) Date of Patent: Sep. 25, 2018

(54) DOUBLE BINDER CLIP

(71) Applicant: Melvin Cuadrado, Charlotte, NC (US)

(72) Inventor: Melvin Cuadrado, Charlotte, NC (US)

( * ) Notice: Subject to any disclaimer, the term of this patent is extended or adjusted under 35 U.S.C. 154(b) by 0 days.

(21) Appl. No.: 15/449,863

(22) Filed: Mar. 3, 2017

(51) Int. Cl.
*B42F 1/00* (2006.01)

(52) U.S. Cl.
CPC ..... *B42F 1/006* (2013.01)

(58) Field of Classification Search
CPC ..... B42F 1/006
See application file for complete search history.

(56) References Cited

U.S. PATENT DOCUMENTS 1,865,453 A * 7/1932 Baltzley ..... B42F 1/006 24/545
2,455,399 A 12/1948 Botts
4,300,268 A 11/1981 Wilson
7,120,969 B2 10/2006 Carls
D701,565 S * 3/2014 Lin ..... D19/65
2001/0032376 A1* 10/2001 Payne ..... B42F 1/006 24/67.5
2015/0306898 A1* 10/2015 Joyner ..... B42F 1/006 24/67.9

* cited by examiner

*Primary Examiner* — David M Upchurch

(57) ABSTRACT

A double binder clip including a single continuous clip body. The single continuous clip body includes a right outer panel, a left outer panel, a substantially U-shaped inner panel, a right top panel disposed between the right outer panel and the substantially U-shaped inner panel, a left top panel disposed between the left outer panel and the substantially U-shaped inner panel, a right curled bottom edge disposed on a bottom surface of the right outer panel, and a left curled bottom edge disposed on a bottom area of the left outer panel. The right outer panel and the left outer panel are spring-biased toward one another. Each of a right lever and a left lever of a pair of looped wire levers is pivotally engageable within each of the right curled bottom edge and the left curled bottom edge, respectively, of the single continuous clip body.

1 Claim, 3 Drawing Sheets

DOUBLE BINDER CLIP

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of binder clips are known in the prior art. However, what has been needed is a double binder clip including a single continuous clip body. What has been further needed is for the single continuous clip body to include a right outer panel, a left outer panel, a substantially U-shaped inner panel, a right top panel disposed between the right outer panel and the substantially U-shaped inner panel, a left top panel disposed between the left outer panel and the substantially U-shaped inner panel, a right curled bottom edge disposed on a bottom surface of the right outer panel, and a left curled bottom edge disposed on a bottom area of the left outer panel. The right outer panel and the left outer panel are spring-biased toward one another. Lastly, what has been needed is for each of a right lever and a left lever of a pair of looped wire levers to be pivotally engageable within each of the right curled bottom edge and the left curled bottom edge, respectively, of the single continuous clip body. The double binder clip is thus uniquely structured to better organize and secure multiple folders and packets of paper with its dual right curled bottom edge and left curled bottom edge that are liftable by a user.

FIELD OF THE INVENTION

The present invention relates to binder clips, and more particularly, to a double binder clip.

SUMMARY OF THE INVENTION

The general purpose of the present double binder clip, described subsequently in greater detail, is to provide a double binder clip which has many novel features that result in a double binder clip which is not anticipated, rendered obvious, suggested, or even implied by prior art, either alone or in combination thereof.

To accomplish this, the present double binder clip includes a single continuous clip body. The single continuous clip body includes a right outer panel, a left outer panel, a substantially U-shaped inner panel, a right top panel disposed between the right outer panel and the substantially U-shaped inner panel, a left top panel disposed between the left outer panel and the substantially U-shaped inner panel, a right curled bottom edge disposed on a bottom surface of the right outer panel, a left curled bottom edge disposed on a bottom area of the left outer panel, a rounded right outer corner disposed between the right outer panel and the right top panel, a rounded left outer corner disposed between the left outer panel and the left top panel, a rounded right inner corner disposed between the right top panel and the substantially U-shaped inner panel, and a rounded left inner corner disposed between the left top panel and the substantially U-shaped inner panel. The right outer panel of the single continuous clip body and the left outer panel of the single continuous clip body are spring-biased toward one another. The rounded right inner corner of the single continuous clip body is disposed immediately adjacent to the rounded left inner corner of the single continuous clip body.

The double binder clip further includes a plurality of a pair of slots including a right pair of slots and a left pair of slots. Each of the right pair of slots and the left pair of slots is disposed within each of the right curled bottom edge and the left curled bottom edge, respectively, of the single continuous clip body. Each of a right lever and a left lever of a pair of semi-flexible looped wire levers is pivotally engageable within each of the right curled bottom edge and the left curled bottom edge, respectively, of the single continuous clip body. Each of the right lever and the left lever is selectively removably from each of the right curled bottom edge and the left curled bottom edge, respectively, through each of the right pair of slots and the left pair of slots, respectively.

Each of the right lever and the left lever of the pair of semi-flexible looped wire levers engages each of the right outer panel and the left outer panel, respectively, of the single continuous clip body. As a result of this engagement, each of the right lever and the left lever of the pair of semi-flexible looped wire levers is configured to outwardly lift each of the right curled bottom edge and the left curled bottom edge, respectively, of the single continuous clip body when a user applies pressure to each of the right lever and the left lever against each of the right outer panel and the left outer panel, respectively, of the single continuous clip body. The lifting of each of the right curled bottom edge and the left curled bottom edge allows a user to easily secure and organize not just a single packet of paper, but at least a pair of packets of paper within each of the openings that are created between the substantially U-shaped inner panel and each of the right outer panel and the left outer panel.

Thus has been broadly outlined the more important features of the present double binder clip so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
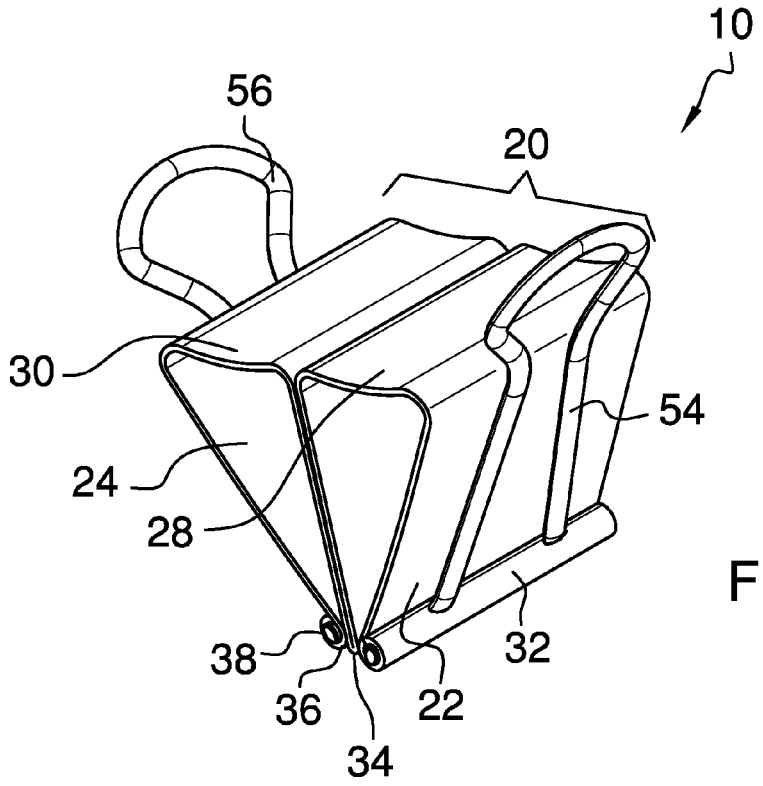
FIG. 1 is a front isometric view.
Figure 2:
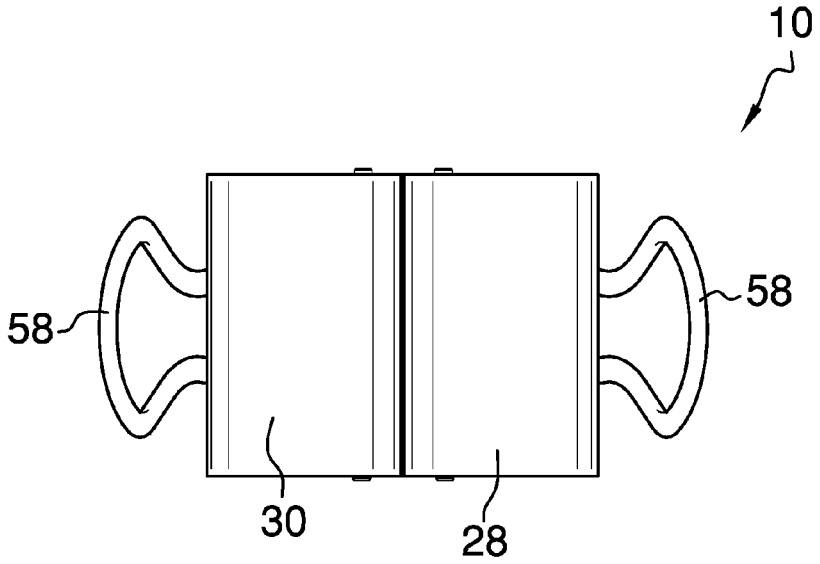
FIG. 2 is a top plan view.
Figure 3:
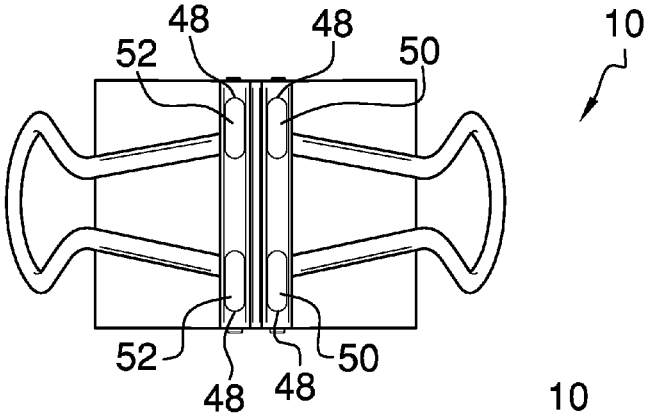
FIG. 3 is a bottom plan view.
Figure 4:
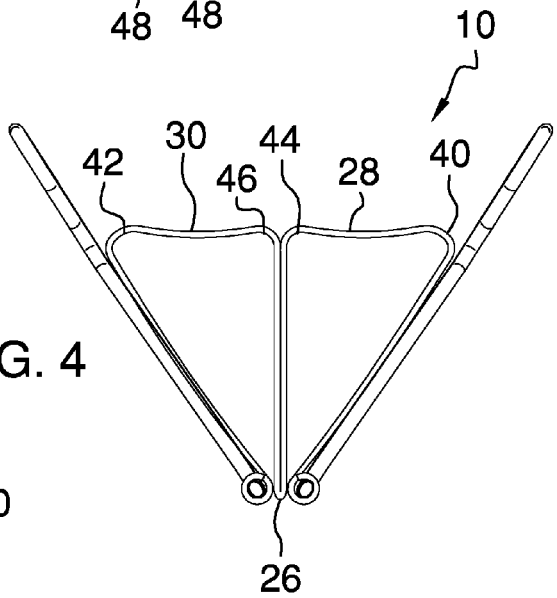
FIG. 4 is a front elevation view.
Figure 5:
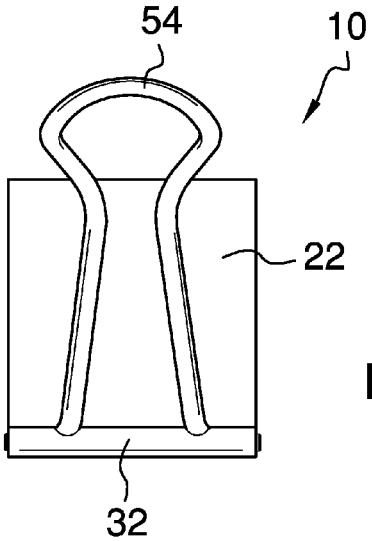
FIG. 5 is a side elevation view.
Figure 6:
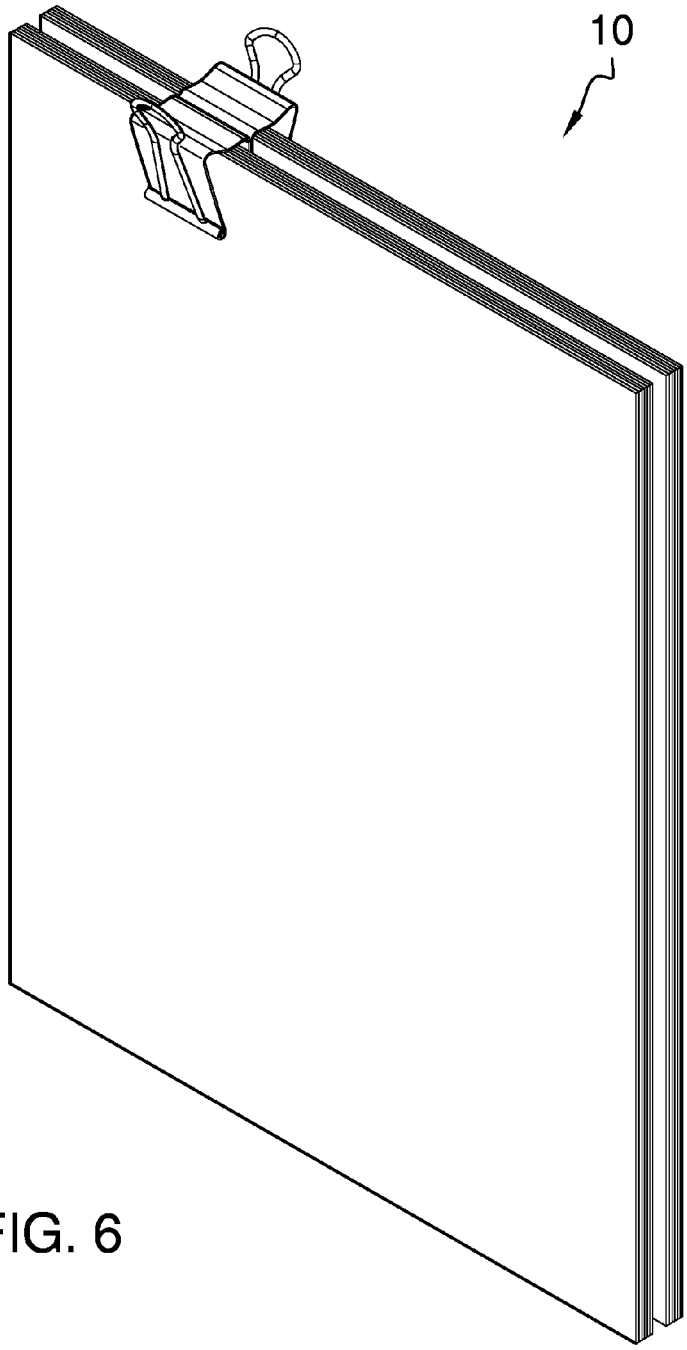
FIG. 6 is an in use view.

With reference now to the drawings, and in particular FIGS. 1 through 6 thereof, an example of the instant double binder clip employing the principles and concepts of the present double binder clip and generally designated by the reference number 10 will be described.

Referring to FIGS. 1 through 6 the present double binder clip 10 is illustrated. The double binder clip 10 includes a single continuous clip body 20. The single continuous clip body 20 includes a right outer panel 22, a left outer panel 24, a substantially U-shaped inner panel 26, a right top panel 28 disposed between the right outer panel 22 and the substantially U-shaped inner panel 26, a left top panel 30 disposed between the left outer panel 24 and the substantially U-shaped inner panel 26, a right curled bottom edge 32 disposed on a bottom surface 34 of the right outer panel 22, a left curled bottom edge 36 disposed on a bottom area 38 of the left outer panel 24, a rounded right outer corner 40 disposed between the right outer panel 22 and the right top panel 28, a rounded left outer corner 42 disposed between the left outer panel 24 and the left top panel 30, a rounded right inner corner 44 disposed between the right top panel 28 and the substantially U-shaped inner panel 26, and a rounded left inner corner 46 disposed between the left top panel 30 and the substantially U-shaped inner panel 26. The right outer panel 22 of the single continuous clip body 20 and the left outer panel 24 of the single continuous clip body 20 are spring-biased toward one another. The rounded right inner corner 44 of the single continuous clip body 20 is disposed immediately adjacent to the rounded left inner corner 46 of the single continuous clip body 20.

The double binder clip 10 further includes a plurality of a pair of slots 48 including a right pair of slots 50 and a left pair of slots 52. Each of the right pair of slots 50 and the left pair of slots 52 is disposed within each of the right curled bottom edge 32 and the left curled bottom edge 36, respectively, of the single continuous clip body 20. Each of a right lever 54 and a left lever 56 of a pair of semi-flexible looped wire levers 58 is pivotally engageable within each of the right curled bottom edge 32 and the left curled bottom edge 36, respectively, of the single continuous clip body 20. Each of the right lever 54 and the left lever 56 is selectively removably from each of the right curled bottom edge 32 and the left curled bottom edge 36, respectively, through each of the right pair of slots 50 and the left pair of slots 52, respectively.

Each of the right lever 54 and the left lever 56 of the pair of semi-flexible looped wire levers 58 engages each of the right outer panel 22 and the left outer panel 24, respectively, of the single continuous clip body 20.

What is claimed is:

1. A double binder clip comprising:

a single continuous clip body comprising a right outer panel, a left outer panel, a substantially U-shaped inner panel, a right top panel disposed between the right outer panel and the substantially U-shaped inner panel, a left top panel disposed between the left outer panel and the substantially U-shaped inner panel, a right curled bottom edge disposed on a bottom surface of the right outer panel, a left curled bottom edge disposed on a bottom area of the left outer panel, a rounded right outer corner disposed between the right outer panel and the right top panel, a rounded left outer corner disposed between the left outer panel and the left top panel, a rounded right inner corner disposed between the right top panel and the substantially U-shaped inner panel, and a rounded left inner corner disposed between the left top panel and the substantially U-shaped inner panel;

wherein the right outer panel of the single continuous clip body and the left outer panel of the single continuous clip body are spring-biased toward one another;

wherein the rounded right inner corner of the single continuous clip body is disposed immediately adjacent to the rounded left inner corner of the single continuous clip body;

a plurality of a pair of slots comprising a right pair of slots and a left pair of slots, wherein each of the right pair of slots and the left pair of slots is disposed within each of the right curled bottom edge and the left curled bottom edge, respectively, of the single continuous clip body; and a pair of semi-flexible looped wire levers comprising a right lever and a left lever, wherein each of the right lever and the left lever is pivotally engageable within each of the right curled bottom edge and the left curled bottom edge, respectively, of the single continuous clip body, wherein each of the right lever and the left lever is selectively removably from each of the right curled bottom edge and the left curled bottom edge, respectively, through each of the right pair of slots and the left pair of slots, respectively;

wherein each of the right lever and the left lever of the pair of semi-flexible looped wire levers engages each of the right outer panel and the left outer panel, respectively, of the single continuous clip body;

wherein each of the right lever and the left lever of the pair of semi-flexible looped wire levers is configured to outwardly lift each of the right curled bottom edge and the left curled bottom edge, respectively, of the single continuous clip body when a user applies pressure to each of the right lever and the left lever against each of the right outer panel and the left outer panel, respectively, of the single continuous clip body.

* * * * *